United States Patent [19]

Howes

[11] Patent Number: 4,573,444

[45] Date of Patent: Mar. 4, 1986

[54] FUEL INJECTION PUMPING APPARATUS

[75] Inventor: Peter Howes, Gerrards Cross, England

[73] Assignee: Lucas Industries Public Limited Company, Birmingham, England

[21] Appl. No.: 670,023

[22] Filed: Nov. 9, 1984

[30] Foreign Application Priority Data

Dec. 1, 1983 [GB] United Kingdom ..... 8332110

[51] Int. Cl.[4] ..... F02M 39/00

[52] U.S. Cl. ..... 123/502; 123/179 L; 123/450

[58] Field of Search ..... 123/502, 501, 500, 450, 123/179 L; 417/462

[56] References Cited

U.S. PATENT DOCUMENTS

| | | | |
|---|---|---|---|
| 3,628,889 | 12/1971 | Kobayashi | 123/502 |
| 4,359,995 | 11/1982 | Mowbray | 123/501 |
| 4,366,796 | 1/1983 | Kaibara | 123/501 |
| 4,473,053 | 9/1984 | Shinoda | 123/501 |
| 4,476,837 | 10/1984 | Salzgeber | 123/501 |
| 4,478,195 | 10/1984 | Dorenkamp | 123/502 |
| 4,502,449 | 3/1985 | Laufer | 123/502 |

FOREIGN PATENT DOCUMENTS

| | | | |
|---|---|---|---|
| 38334 | 3/1983 | Japan | 123/502 |

*Primary Examiner*—Carl Stuart Miller

[57] ABSTRACT

A fuel injection pumping apparatus of the rotary distributor type includes a cam ring the angular setting of which can be adjusted to determine the timing of delivery of fuel. In order to adjust the setting of the cam ring first and second fluid pressure operable pistons are arranged in parallel side by side relationship and are each coupled to the cam ring by a radial arm. The first piston is subject to a speed dependent pressure generated within the apparatus to provide normal speed advance and the second piston under the control of a valve can be subjected to said pressure to give full advance when the associated engine is cold and up to a predetermined engine load.

7 Claims, 5 Drawing Figures

FUEL INJECTION PUMPING APPARATUS

This invention relates to a fuel injection pumping apparatus for supplying fuel to an internal combustion engine, the apparatus being of the kind comprising a body, a rotary distributor member mounted in the body, a high pressure pump including a plunger mounted in a bore in the distributor member and a cam ring mounted in the body, the cam ring defining a cam lobe which as the distributor member is rotated imparts inward movement to the plunger to displace fuel from said bore, the displaced fuel being directed by the distributor member to an outlet, a lower pressure fuel supply pump for delivering fuel at a pressure which varies in accordance with the speed at which the apparatus is driven, control means for controlling the fuel flow from the low pressure to the high pressure pump thereby to determine the quantity of fuel supplied through said outlet and means for adjusting the angular setting of said cam ring to vary the timing of delivery of fuel by the apparatus.

The object of the present invention is to provide an apparatus of the kind specified in a simple and convenient form.

According to the invention said means for adjusting the angular setting of the cam ring comprises first and second pistons disposed in parallel side by side relationship, means coupling the pistons to the cam ring, resilient means biasing the pistons to urge the cam ring in one angular direction, and means for varying the fluid pressures applied to said pistons.

Figure 1:
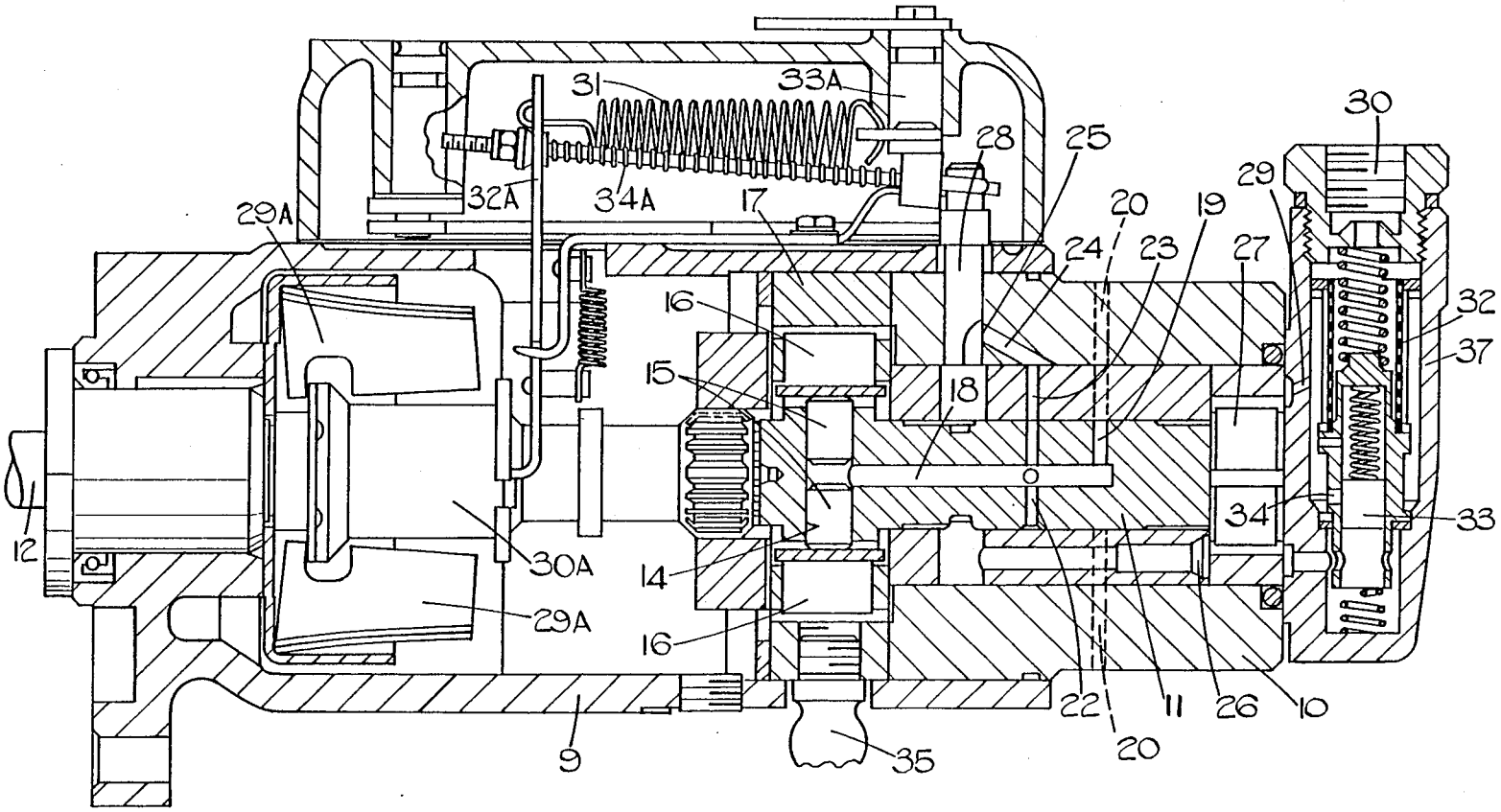
Figure 2:
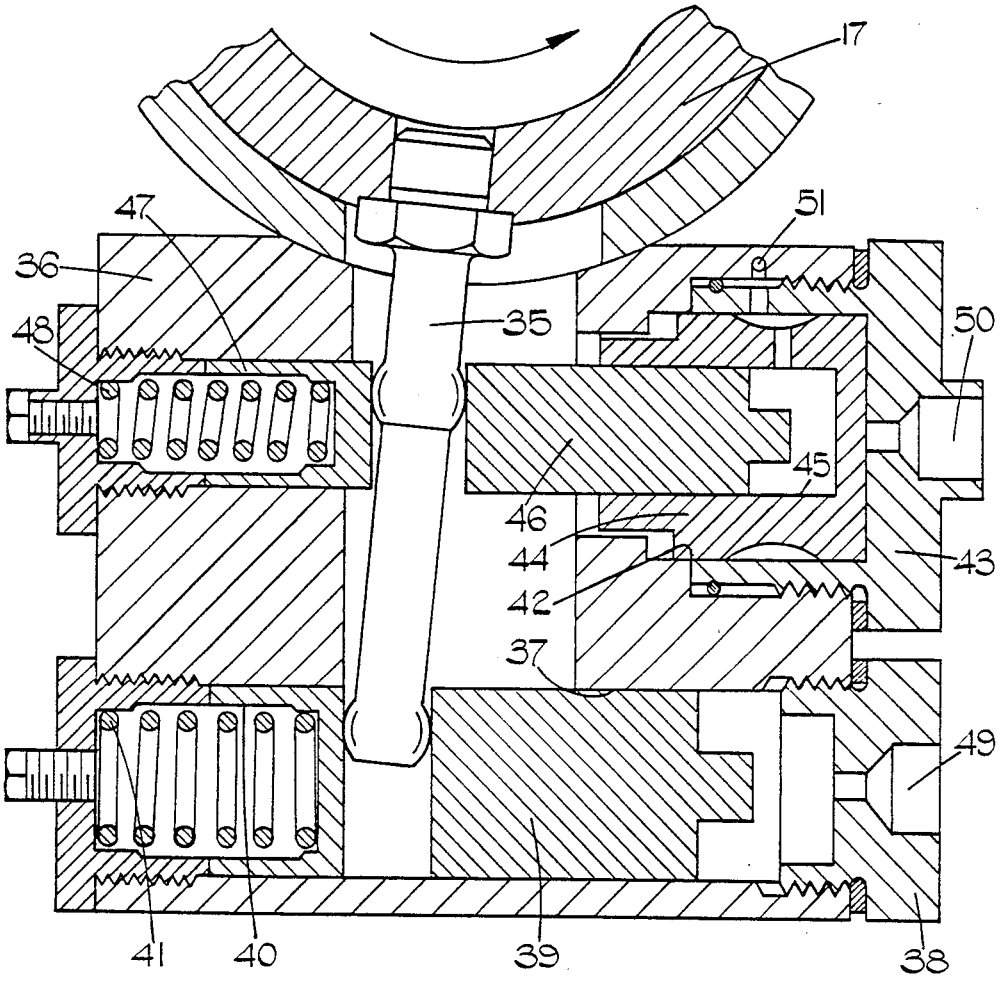
Figure 3:
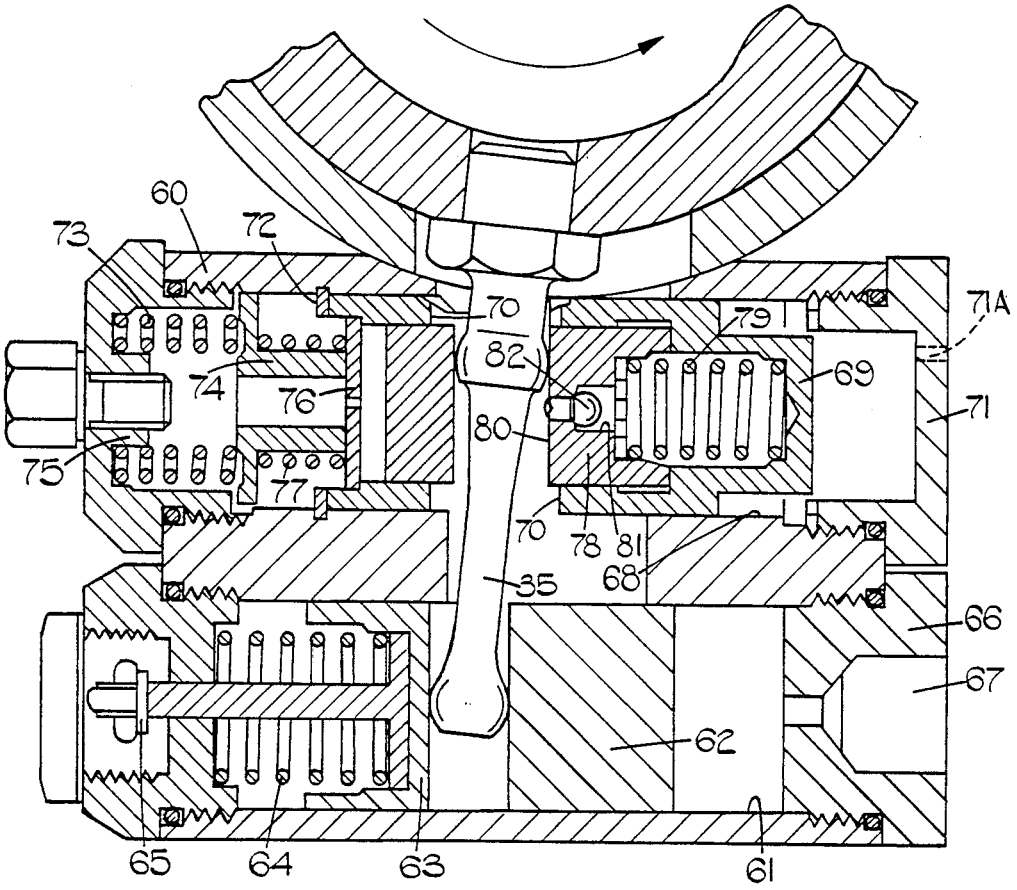
Figure 4:
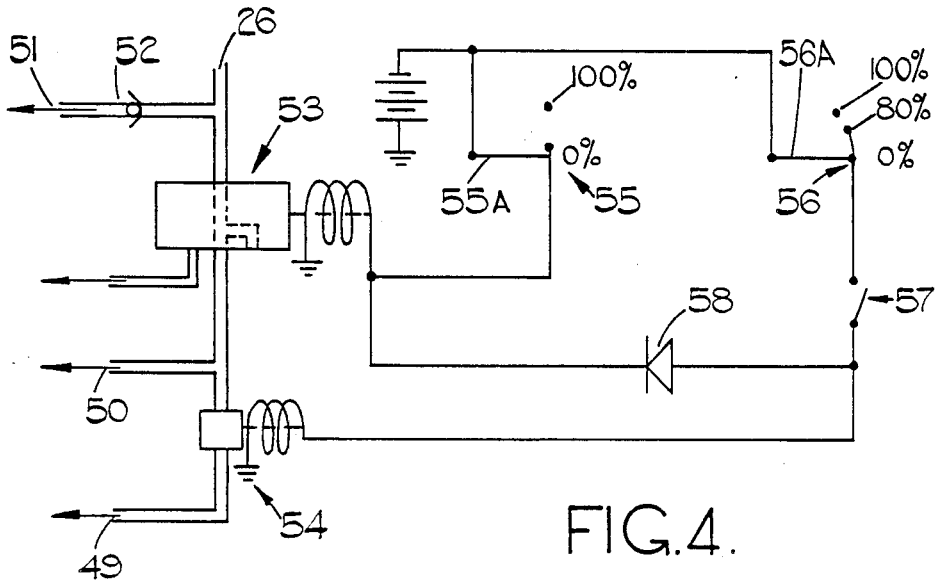
Figure 5:
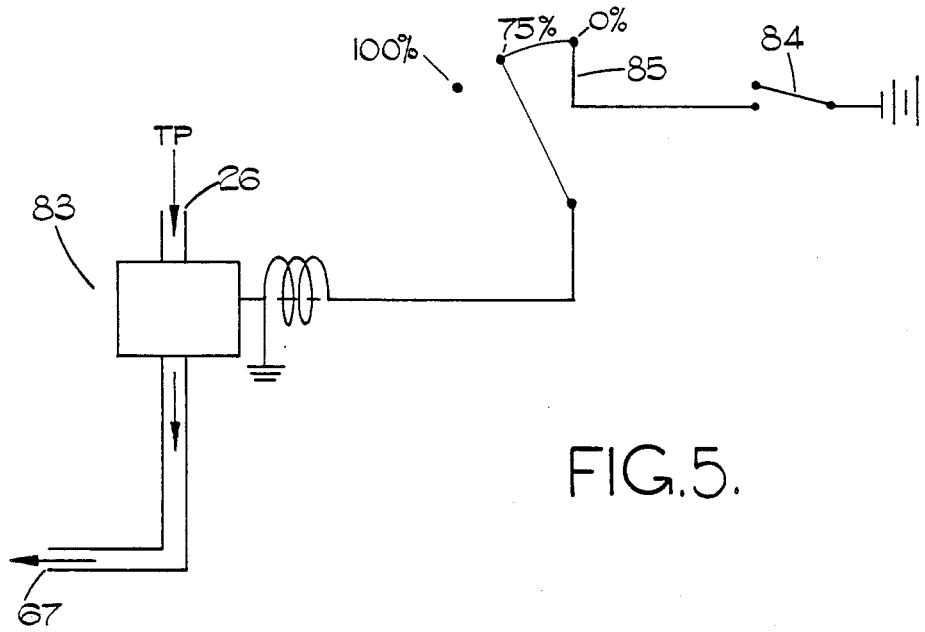

In the accompanying drawings:

FIG. 1 is a sectional side elevation of one example of an apparatus in accordance with the invention, FIG. 2 is a sectional side elevation of a portion of the apparatus omitted from FIG. 1, and FIG. 3 is a view similar to FIG. 2 showing a modified form of the part of the apparatus seen in FIG. 2, and FIGS. 4 and 5 are electro/hydraulic systems associated with the parts of the apparatus seen in FIGS. 2 and 3 respectively.

Referring to FIG. 1 of the drawings the apparatus comprises a two part body 9, 10 the part 9 being provided with an open end in which is located the part 10 and the part 10 having a close fitting relationship with the wall of the bore defined in the part 9 of the body.

Formed within the part 10 of the body is a bore in which is mounted a rotary cylindrical distributor member 11. This is coupled to an input shaft 12 which is located in the part 9 of the body and which is adapted to be driven in timed relationship with an engine with which the apparatus is associated. Formed within the distributor member is a transversely extending bore 14 in which is mounted a pair of reciprocable plungers 15 which are arranged to be moved inwardly as the distributor member rotates, through the intermediary of a pair of rollers 16 respectively, by cam lobes not shown formed on the internal peripheral surface of an annular cam ring 17 mounted for angular movement within the part 9 of the body.

Formed in the distributor member 11 is a longitudinally extending passage 18 which at one end is in communication with the bore 14 and at its other end communicates with a radially disposed delivery passage 19. The passage 19 is arranged to register in turn with a plurality of equiangularly spaced outlet ports 20 which are formed in the part 10 of the body and which in use are connected by pipe lines respectively to injection nozzles mounted on the associated engine. The registration of a passage 19 with an outlet 20 takes place during the whole time the plungers 15 are being moved inwardly so that liquid fuel in the bore 14 will be displaced by way of an outlet 20, to a combustion chamber of the associated engine.

At another point the longitudinal passage 18 is in communication with a plurality of radially disposed inlet passages 22 which are arranged to register in turn with an inlet port 23 formed in the body. The inlet port 23 communicates by way of a passage 24 with a control port 25 which in turn is in communication with the outlet 26 of a low pressure fuel supply pump 27. The effective size of the control port 25 can be varied by varying the angular setting of a throttle valve member 28 which has an axial groove formed therein. The arrangement is such that when an inlet passage 22 registers with the inlet port 23, fuel will flow from the outlet 26 of the low pressure pump to the bore 14 to move the plungers 15 outwardly. The aforesaid registration takes place only during the time when the delivery passage 19 is out of register with an outlet 20 and during the time when the rollers 16 are clear of the cam lobes. By adjustment of the angular setting of the throttle member 28 the rate at which fuel is supplied to the bore 14 can be controlled and hence also the amount of fuel delivered to the engine.

The low pressure pump 27 the rotary component of which is carried by the distributor member, is provided with an inlet which is in communication with an inlet port 30 formed in a hollow port 37 which is secured to the body of the apparatus. The inlet communicates with the inlet port 30 by way of a passage 29 also formed in the part 37 and the latter has mounted therein a tubular filter element 32 and a relief valve which includes a spring loaded element 33. One end of the element 33 is exposed to the pressure of fuel at the outlet 26 and it controls the size of a spill port 34. The arrangement is such that the low pressure pump always delivers more fuel than is required to be delivered to the engine with the result that the output pressure of the low pressure pump is controlled in a manner which is dependent upon the speed of the engine and which increases as the speed thereof increases.

The angular setting of the throttle member 28 is conveniently controlled by a mechanical governor which includes weights 29A which are accommodated within a cage driven by the shaft 12. The weights act upon an axially movable flanged collar 30A which is mounted about the shaft 12 and the axial movement of the collar is resisted by a governor spring 31 which is mounted between one end of a pivotal lever 32A and an operator adjustable member 33A. The latter is connected to for example the throttle pedal of the vehicle of which the engine associated with the apparatus forms part. The same end of the lever 32A is connected to an arm on the throttle member 28 by means of a tie rod 34A and the opposite end of the lever 32A is engaged with the collar 30A. The arrangement is such that as the speed of rotation of the engine increases, the weights 29 will move outwardly and will impart axial movement to the collar 30A against the action of the spring 31. The pivotal movement of the lever 32 is transmitted to the throttle member in such a manner that the latter is moved angularly to reduce the amount of fuel which can be supplied to the engine. The opposite effect is obtained if the engine speed should decrease. If the operator adjustable member 33A is moved to vary the force exerted by the spring then as the aforesaid force is decreased, the throttle member will move angularly to reduce the amount of fuel supplied to the engine and vice versa.

With this form of apparatus the timing of fuel delivery by the apparatus to the associated engine will vary as the quantity of fuel supplied is varied. As the quantity of fuel increases the timing of the start of delivery of fuel will advance and vice versa. In order to provide a control over the timing of fuel delivery, the cam 17 is angularly adjustable and is provided with a peg 35 which extends through an aperture in the body.

Referring now to FIG. 2, there is attached to the body of the apparatus a housing 36 in which is defined a first cylinder 37 the axis of which lies parallel to a tangent of the cam 17. The outer end of the cylinder 37 is closed by an end cap 38 and located within the cylinder is a piston 39 which bears against a bulbous portion on the peg 35. A plunger 40 is located in the portion of the cylinder beyond the peg and is urged into contact with the peg by a coiled compression spring 41. The piston and plunger may be formed in one piece.

Also provided in the housing 36 is part of a cylinder 42 the main portion of which is defined in an end cap 43 which is secured to the housing. Within the cylinder 42 is a piston 44 which defines a cylinder 45 for a piston 46, the piston 46 engaging with a further bulbous portion on the peg 35. A further plunger 47 is provided and this is biased by a further coiled compression spring 48 into contact with the further bulbous portion of the peg 35. The piston 46 and the plunger 47 may be formed in one piece.

The end caps 38 and 43 are provided with fluid inlets 49, 50 respectively and the portion of the cylinder 45 defined between the piston 46 and the base wall of the piston 44 is connected to a fluid pressure inlet passage 51 in the housing 36, the passage 51 being connected by registering passages in the end cap 43 and the piston 44 to the aforesaid cylinder 45. Referring now to FIG. 4, the passage 51 is connected to the outlet 26 of the low pressure pump by way of a check valve 52 the purpose of which is to absorb the reaction of the rollers 16 upon the cam lobes. Also provided is a solenoid operable control valve 53 which controls the supply of fuel under pressure to the inlet 50. When the associated solenoid is energised the valve connects the inlet 50 to the outlet 26 and when it is de-energized, the valve connects the inlet 50 to the interior of the body of the apparatus which is at a low pressure. In addition, the valve 53 controls in conjunction with a solenoid controlled on/off valve 54, the application of pressure to the piston 39 by way of the inlet 49. The solenoids of the valves are controlled by three switches. Two of the switches 55, 56 are actuated by an arm on the throttle member 28.

The switches have respective sliders 55A, 56A which are connected to a source of electric supply. The switch 55 remains closed for only a short distance as the throttle member is moved away from its idling position and directly controls the energisation of the valve 53. The switch 56 remains closed for about 80% of the allowed movement between the idle and full load positions of the throttle member and controls the energization of the valve 54 by way of an engine coolant temperature responsive switch 57 which is closed when the temperature is below a predetermined value. A diode 58 is connected between the valves and is poled so that whenever the valve 54 is energised the valve 53 is energized.

The direction of rotation of the distributor member is shown by the arrow in FIG. 2 and therefore movement of the cam ring 17 in the clockwise direction will effect advancement of the timing of delivery of fuel to the associated engine. The piston 46 is utilised to provide the normal speed advance and the piston 46 under the influence of the pressure at the outlet 26, which increases as the speed increases, moves the cam ring against the action of the springs 41 and 48 which are biasing the plungers. The setting of the cam ring will therefore vary in accordance with the speed at which the apparatus is driven.

It is required to provide limited advance of the timing of delivery of fuel when the engine is hot and is idling in order to compensate for the fact that with this form of apparatus at idling speed when the quantity of fuel supplied is small, the timing of fuel delivery will be retarded. In the idling condition the output pressure of the low pressure pump will be comparatively low such that the piston 46 may be in contact with the base wall of the piston 45. In order to provide advance therefore in this situation the inlet 50 is connected by way of the control valve 53 to the outlet 26, the valve 53 being energized by way of the switch 55. The piston 44 is thus exposed to the output pressure of the low pressure pump and since the piston 44 has a larger end area than the piston 46, movement of the cam ring in the direction to advance the timing of delivery of fuel will occur against the action of the springs 41 and 48. The extent of movement is however limited because the portion of the cylinder 42 defined by the housing 36 and the piston 44 both define steps which abut to limit the extent of movement of the cam ring.

When the engine is cold it is desirable to be able to provide full advance at idling to reduce the formation of so called white smoke emissions. This is achieved by the fact that both valves 53 and 54 will be energised since switch 57 will also be closed. The inlets 49 and 50 are both connected to the outlet 26 so that the output pressure of the low pressure pump is applied to the piston 39. Since the piston 46 is also subjected to the pressure at the outlet 26 the force exerted by the two pistons 39 and 46 acting together is sufficient to move the cam ring its maximum extent against the action of the springs 41 and 48. This setting is maintained up to about 80% of full load by the switch 56, the diode supplying power to the valve 53 after the switch 55 has opened.

Under conditions of maximum acceleration, when the maximum amount of fuel is being supplied to the engine, it is necessary even if the engine is cold, that the advance achieved by the effect of the pistons 39 and 44 is removed so that the piston 46 alone determines the timing of delivery of fuel, this condition is obtained when switch 56 is opened. When the engine coolant reaches the predetermined temperature switch 57 is opened so that valve 44 will close and valve 53 can only be energized when the switch 55 is closed.

In the modification shown in FIG. 3 the housing 60 defines a cylinder 61 in which is mounted a piston 62 engageable with the peg 35. A plunger 63 is disposed on the opposite side of the peg to the piston and is spring loaded towards the peg by means of a coiled compression spring 64. As with the example of FIG. 2 the piston and plunger may be formed in one piece. The extent of movement of the plunger under the action of the spring, is limited by an adjustable abutment 65 which is carried upon a spring abutment which engages with the plunger. The cylinder 61 is closed by an end closure 66 in which is located a fluid inlet 67.

The housing 60 defines a second cylinder 68 in which is located a hollow piston 69. The skirt of the piston is provided with a pair of transversely aligned openings 70 through which the peg 35 extends but the size of the opening 70 is such that the skirt of the piston does not engage the peg under any circumstances. The cylinder 68 is provided with an end cap 71 and a passage 71A, communicates with the cylinder and places the cylinder in communication with the outlet of the low pressure pump. The movement of the piston under the action of the outlet pressure of the pump is limited by an abutment in the form of a circlip 72 which is retained within a groove in the cylinder and the movement of the piston is against the action of a spring pack 73 one end of which bears against an end closure plug 75 and the other end of which bears against an abutment member 74. The abutment member 74 is of hollow cylindrical form and engages a plate 76 which is mounted in the open end of the piston 69. In addition, the abutment member 74 is surrounded by a light coiled compression spring 77. The spring 77 comes into action when the associated engine is at rest and it acts to urge the piston 69 an additional amount after a flange on the abutment 74 has engaged with the circlip 72.

Slidable within the cylinder defined by the piston 69 is a plunger 78 in which is formed a bore 80 through which the peg 35 extends. The bore 80 is of a diameter such that it engages a bulbous portion on the peg 35. The plunger is biased by a spring 79 towards the plate 76 and it is provided with a passage 81 whereby the chamber defined by the plunger 78 and the piston 69 and which accommodates the spring 79, communicates with the interior of the pump body. A ball check valve 82 is provided to trap fluid within this chamber.

The direction of rotation of the distributor member is indicated by the arrow and hence movement of the pistons towards the left will result in advancement of the timing of fuel delivery. The parts of the pump are shown in the position which is attained at maximum speed. It will be noted that the piston 69 has moved into contact with the circlip 72 under the action of the fuel under pressure in the cylinder 68. The movement of the piston is against the combined action of the spring pack 73 and also the spring 64. Under normal operation no fluid under pressure is supplied to the inlet 67 and furthermore, the plunger 78 due to the reaction of the cam lobes with the rollers, is moved into engagement with a step defined in the piston 69. As the speed of the associated engine is varied, the piston 69 will adopt a position depending on the output pressure of the low pressure pump and the timing of fuel delivery will vary with the speed.

When the engine is idling the output pressure of the low pressure pump falls to a value such that the piston 69 will be moved towards the right by the spring pack 73 and the spring 64 until the flange on the member 74 engages with the circlip 72. However, at idling the reaction of the rollers with the cam lobes is reduced and in this situation the spring 79 can move the plunger 78 relative to the piston 69, such movement having the effect of providing some advance of the timing of delivery of fuel. The travel in the direction to advance fuel delivery in this manner is limited so that the maximum advance which can be obtained is about 4°. The check valve 82 acts to create a hydraulic lock in the chamber in the piston 69 when the followers engage the cam lobes and thereby provides a damping action.

In FIG. 5 there is shown an electro-hydraulic circuit for controlling the application of pressure to the piston 62, the source of pressure being the outlet 26 of the low pressure pump. The circuit includes a solenoid operable control valve 83 which when energised, opens to connect the outlet 26 of the low pressure pump with the inlet 67. The supply of electric current to the solenoid is controlled by a pair of switches which are connected in series. The first such switch 84 is a switch responsive to the engine coolant temperature and which is arranged to close when the temperature falls below a predetermined value. The second switch 85 is a switch which is associated with the throttle control of the vehicle. It is closed between idle and the three quarters full load position. Conveniently it is mounted on the body of the pumping apparatus itself and in the case of a two speed governor, can be connected to the external control member 33 of the apparatus but in the case of an all-speed governor as shown in FIG. 1, it must be connected to the governor lever 32 or throttle member 28. In both cases therefore it is responsive to the amount of fuel which is being supplied to the engine.

Assuming now that the engine is cold so that the switch 84 is closed, and the throttle is set to less than three quarters full load. In this situation the valve 83 will be energized to allow fluid pressure to be applied to the piston 62 and an additional force is applied to the peg 35 by the piston 62 and this force supplements the force exerted by the piston 69. The effect is therefore that the advance curve is shifted so that the maximum advance of about 8° is obtained lower down the speed range of the engine. If the driver of the vehicle selects maximum fuel, the switch 85 opens and the piston 69 alone controls the timing of delivery of fuel as will also be the case when the engine is hot.

The abutment 65 which is associated with the plunger 63 is provided to ensure that at idling speeds the movement of the plunger 78 which gives advancement of the timing of delivery of fuel at idling, is not impaired. The spring 77 comes into operation when the engine is at rest and effects further movement of the piston 69 beyond the position of the piston which prevails at engine idling and as determined by the abutment of the flange on the abutment member 74 with the circlip 72. Starting of the engine is therefore achieved with maximum retard.

I claim:

1. A fuel injection nozzle pumping apparatus for supplying fuel to an internal combustion engine, the apparatus comprising a body, a rotary distributor member mounted in the body, a high pressure pump including a plunger mounted in a bore in the distributor member and a cam ring mounted in the body, the cam ring defining a cam lobe which as the distributor member is rotated imparts inward movement to the plunger to displace fuel from said bore, the displaced fuel being directed by the distributor member to an outlet, a low pressure fuel supply pump for delivering fuel at a pressure which varies in accordance with the speed at which the apparatus is driven, control means for controlling the fuel flow from the low pressure to the high pressure pump thereby to determine the quantity of fuel supplied through said outlet, means for adjusting the angular setting of the cam ring to vary the timing of fuel delivery by the apparatus, said means including first and second pistons disposed in parallel side-by-side relationship, means coupling the pistons to the cam ring, resilient means biasing the pistons to urge the cam ring in one angular direction to retard the delivery of fuel, means for varying the fluid pressure applied to the pistons, the fluid pressure acting on said pistons in the direction to advance the timing of fuel delivery, a first cylinder housing the first of said pistons and passage means connecting one end of said cylinder to an outlet of the low pressure fuel supply pump, whereby the position of the piston is responsive to the speed at which the apparatus is driven, and a second cylinder housing the second of said pistons, a valve for admitting fuel under pressure to said second cylinder, a first switch responsive in use to the temperature of the associated engine and a second switch responsive to the setting of said control means, said switches controlling said valve, whereby fuel under pressure is supplied to said second cylinder only when the engine temperature is below a predetermined value and the quantity of fuel supplied by the apparatus is less than a predetermined value.

2. An apparatus according to claim 1 in which said first cylinder is defined within a further piston housed within a further cylinder, a further valve for controlling the admission of fuel under pressure to said further cylinder, electrical circuit means operable to ensure that said further valve allows fuel under pressure into said further cylinder whenever said first mentioned valve allows fuel under pressure into said second cylinder.

3. An apparatus according to claim 2 including a further switch responsive to the setting of said control means, said further switch being arranged such that said further valve is operated to allow fuel under pressure to flow into said further cylinder only when the quantity of fuel supplied by the apparatus is less than a second predetermined value lower than said first mentioned predetermined value.

4. An apparatus according to claim 2 or claim 3 including means for limiting the movement of said further piston.

5. An apparatus according to claim 1 including a plunger slidably mounted in said first piston and coupled to said cam ring, and means for limiting the relative movement of the plunger and piston, and resilient means acting to urge the plunger relative to the piston in the direction to advance the timing of fuel delivery.

6. An apparatus according to claim 5 including a chamber defined by said plunger and said first piston and a check valve to control fuel flow from said chamber.

7. An apparatus according to claim 5 or claim 6 in which the resilient means biasing the first piston comprises a spring pack one end of which bears against a fixed component, an abutment engaged by the other end of the spring pack, said abutment engaging said first piston, means for limiting the movement of the abutment under the action of the spring pack, and a further spring acting intermediate the abutment and said first piston, said further spring acting to urge the first piston a further amount in the direction to retard the timing of fuel delivery after the movement of the abutment has been halted.

* * * * *